United States Patent [19]

Lee

[11] Patent Number: 5,011,440

[45] Date of Patent: Apr. 30, 1991

[54] WIRE CONNECTOR

[76] Inventor: Chun-Te Lee, No. 98-1, Chiu-She Lane, Chiu-She Li, Pei-Tun Dist., Taichung, Taiwan

[21] Appl. No.: 579,573

[22] Filed: Sep. 10, 1990

[51] Int. Cl.[5] ..... H01R 11/22

[52] U.S. Cl. ..... 439/857; 439/750; 439/787; 439/654

[58] Field of Search ..... 439/851-857, 439/861, 862, 816, 738, 750, 786, 787, 654, 833-836, 839

[56] References Cited

U.S. PATENT DOCUMENTS

| | | | |
|---|---|---|---|
| 3,757,279 | 9/1973 | Winston | 439/584 |
| 4,534,610 | 8/1985 | Takihara | 439/839 |
| 4,795,370 | 1/1989 | Freitag | 439/584 |
| 4,854,893 | 8/1989 | Morris | 439/578 |

*Primary Examiner*—David L. Pirlot

*Attorney, Agent, or Firm*—Harness, Dickey & Pierce

[57] ABSTRACT

A wire connector includes a first tubular member having a top wall with a top opening and a bottom wall with a bottom through-hole; a second tubular having a upper wall with a top through-hole and a lower wall with a bottom opening; a pair of tongs having a joined bottom section and bent tips. The improvements are characterized by the first tubular member having a pair of opposed braces extending from the top wall, adjacent to the top opening, and each of the two bent tips having a W-shaped section with a first upper bend and a second lower bend, the first upper and second lower bends being adjacent to each other at the upper tip of each tine of the tongs, the second lower bends be spaced apart and correspondingly curved towards each other, the first upper bends abutting each other, adjacent to the second lower bends and opposite to the bottom joined section of the pair of tongs.

2 Claims, 4 Drawing Sheets

WIRE CONNECTOR

BACKGROUND OF THE INVENTION

The present invention relates to a wire connector more particularly to a wire connector having a base which prevents radial displacement of the mandibles of the clamping means of the same, said clamping means having a strong grip which can firmly hold wires of any size.

FIG. 1 shows an exploded view of a wire connector of the prior art. Accordingly, it includes a tubular sleeve housing a pair of conducting tongs which are biased to clamp a wire or terminal between them.

The tubular housing, however, lacks a means to anchor the pair of tongs in the same. This freedom of movement detracts from the clamping strenght of the tongs.

Further, the resilient property of the tongs is adversely affected by long periods of clamping anything larger than a smaller radius wire.

Still another drawback is that the axes of the tongs will tend to shift radially, so as to occupy different planes, when a larger wire is inserted in the connector. When the tongs are no longer coplanal, they can release the held wire, this also stems from the lack of anchorage of the tongs.

SUMMARY OF THE INVENTION

Therefore, it is a main object of the present invention to provide a wire connector free from above drawbacks and which is suited to used in TV antennae.

Another object of the present invention is to provide a wire connector having improved clamping strength and which can firmly clamp wires of any size.

Still another object of the present invention is to provide a wire connector including a base which prevents independent radial movement of the separate members of the clamping means, so that the connector does not disengage itself from thick wires. Thus, according to the present invention, the tongs are modified to include two opposed braces extending from the tubular housing portion which confine the tip section of the tongs to coplanar movement. To overcome the problem of reduced resiliency, the tip portion of each tong includes an extra bend, so that according to the present invention, the tip resembles a "W" as opposed to the conventional "V". The bottom bends are held apart by the top bends, which extend inward farther, thereby allowing the tongs to clamp a small wire by the first top bends, and a larger ones by the second, bottom bends, or both bends.

BRIEF DESCRIPTION OF THE DRAWING

Other features and advantages of the present invention will become more apparent in the following detailed description, including the drawings, all of which show a non-limiting of the present invention, of which.

DETAILED DESCRIPTION OF THE PREFERRED EMBODIMENT

Figure 1:
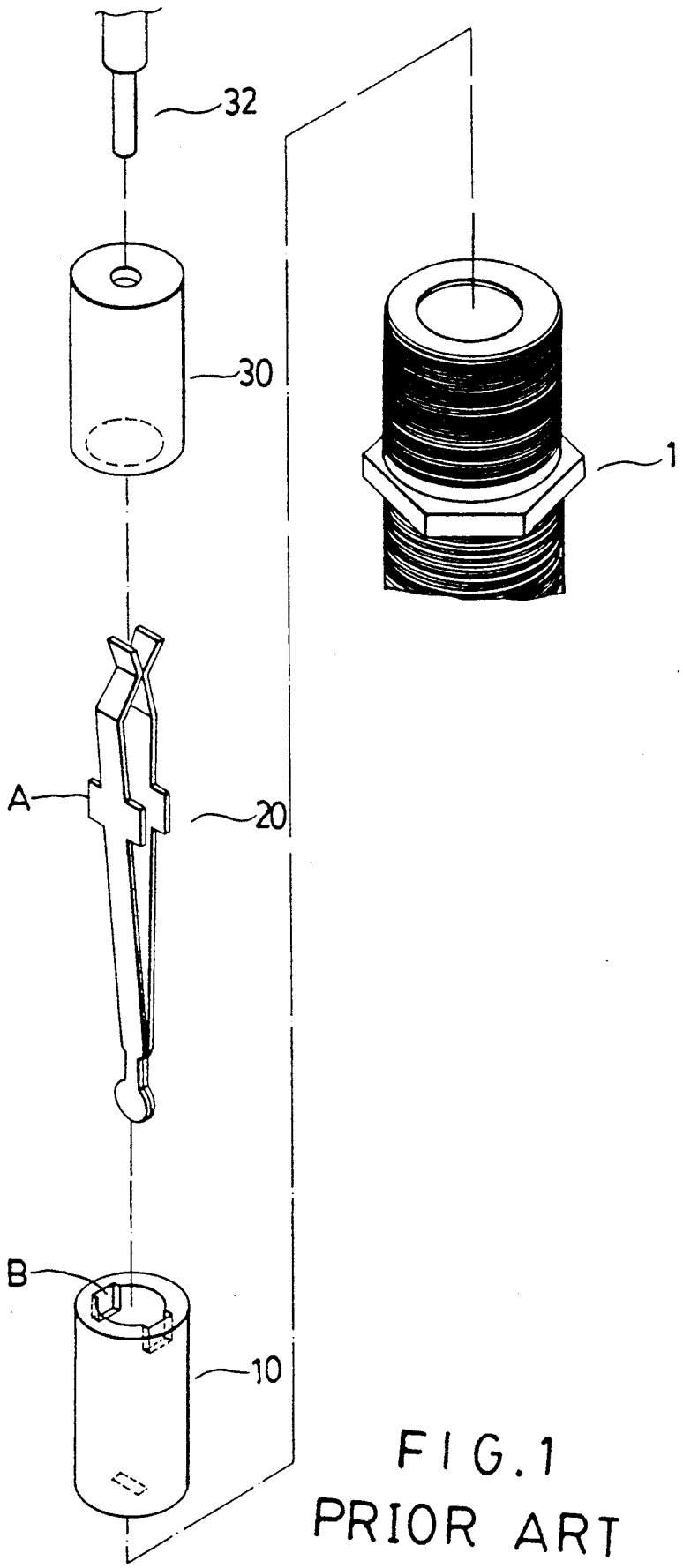
FIG. 1 PRIOR ART
FIG. 1 is an exploded view of a wire connector of the prior art.
Figure 2:
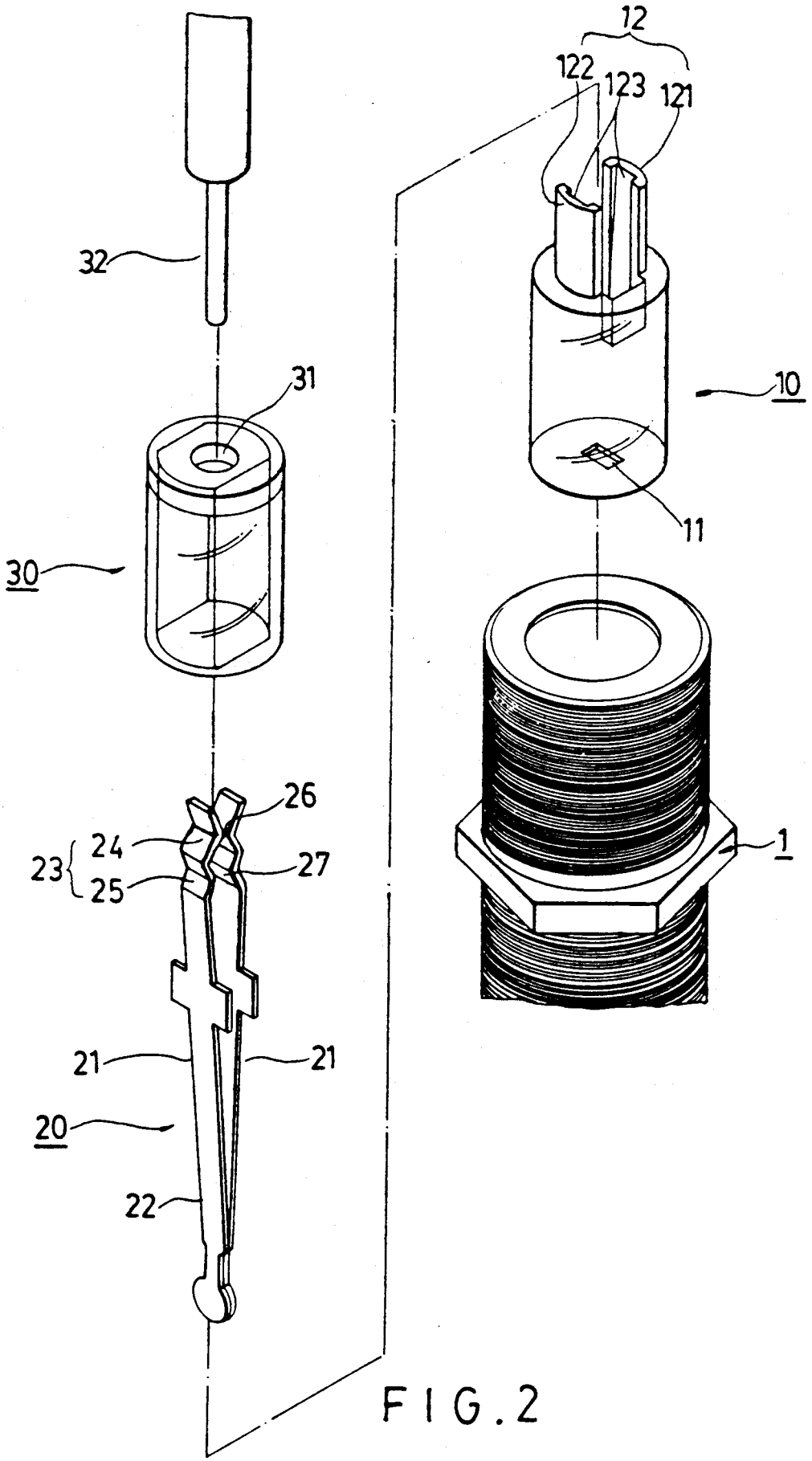
FIG. 2 is an exploded view of a wire connector of the present invention.

FIG. 2 shows an exploded view of a wire connector of the present invention. Accordingly, it includes a bottom tubular housing member 10 having a top wall with a top opening and a lower wall with a bottom throughhole 11, a top tubular housing member 30 having a upper wall with a top through-hole 31 and a bottom wall with a bottom opening. A pair of tongs 20 joined at the bottom ends, being adapted to be received in the bottom tubular housing member 10, and a tip section 23 with two bend portions (24, 25), which tip section is adapted to be received in the top tubular housing member 30. The tip 23 of each of the tongs has a substantially W-shaped portion with a upper bend (24, 26) which top bends abut each other under force of the resiliency of the tongs, and a second lower bend (25, 27) which are held spaced apart from each other, adjacent to the upper bends, because the peaks of the second lower bends are shallower.

Figure 3:
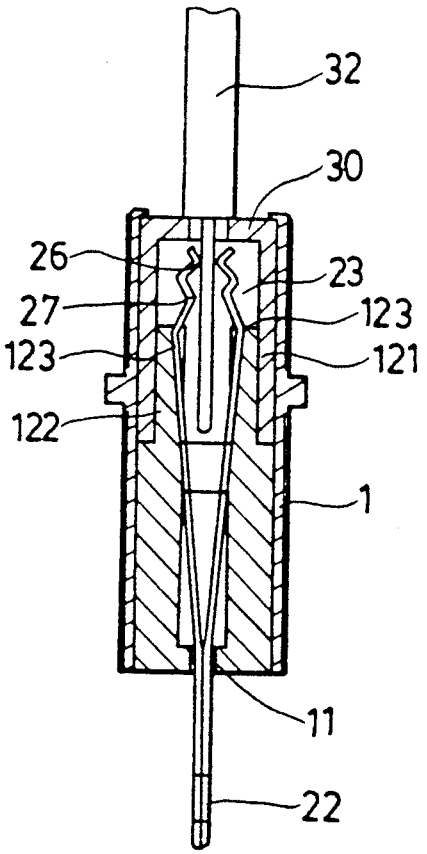
FIG. 3 shows a small wire being clamped by first two bend portions of a pair of tongs of the wire connector according to the present invention.
Figure 4:
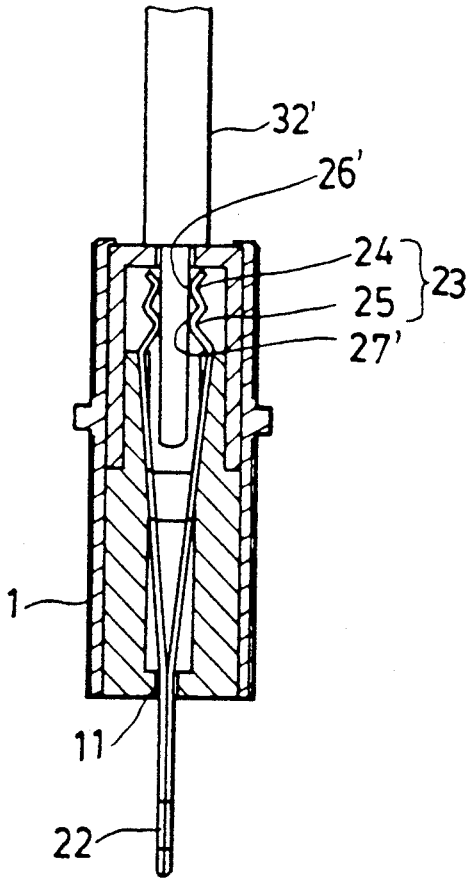
FIG. 4 shows a bigger wire being clamped by first and second two portions of the pair of tongs of the wire connector according to the present invention.

A pair of opposed braces (121, 122) extend upward from the top wall of the bottom tubular housing member 10, adjacent to the top opening of the same. Each one of the braces has a longitudinal inclined groove 123, in which the joined bottom section 21 of the pair of tongs 20 is seated and anchored. The braces 12 prevent the radial movement of the tongs. A small wire 32, passing through the top through-hole 31 of the top tubular member 30 is clamped by the first bends (24, 26), as shown in FIG. 3, and a bigger wire 32, passing through the top through-hole 31 of the top tubular housing member 30 is clamped by both sets of bends (24, 26), and (25, 27), as shown in FIG. 4.

Figure 5:
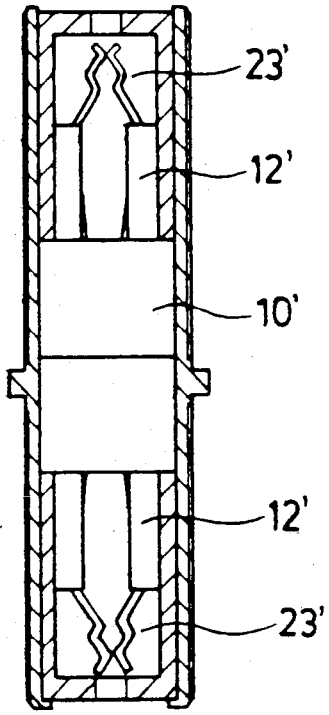
FIG. 5 is another form of the connector of FIG. 1 according to the present invention.

In another preferred embodiment, tongs extend both upward and downward from a central joint on the same, to form an "X" in profile. Both clamping ends are respectively shaped like as explained above, to perform the same task. This embodiment would include a third tubular housing member to sheath the section, and an additional set of braces allowing them to be used as shown in FIG. 5. Note that the clamps operate independently, more effectively to connect wires of differing widths.

While the invention has been described in what is considered to be most practical and preferred embodiment, the invention is not to be limited to the disclosure only, but on the contrary, it is intended to cover various modifications and equivalent arrangements within the broadest interpretation of the invention so as to emcompass all such modifications and equivalent arrangements.

I claim:

1. A wire connector including:

a first tubular member having a lower wall with a bottom through-hole and an upper wall with a top opening;

a second tubular member having a top wall with a top through-hole and a bottom wall with a bottom opening;

a pair of tongs joined at a bottom to form a V in profile and a top section with two bend portions, one on each tong, said two bend portions being abutting with each other, and said bottom joined section being adapted to be received in said first tubular member, said top section being adapted to be received in said second tubular member; wherein the improvements are characterized by said first tubular member having a pair of opposed braces extending upward from said top wall, adjacent to said top opening, said pair of opposed braces preventing radial movement of said pair of tongs when said bottom joined section of said pair of tongs is seated in said first tubular member, and each of said bend portions of said pair of tongs being substantially W-shaped with a first upper bend and a second lower bend, said second lower bends being spaced apart and correspondingly curved towards each other, said first upper bends abutting each other, adjacent to said second lower bends and opposite said bottom joined section of said pair of tongs.

2. A wire connector as claimed in claim 1, wherein each of said two opposed braces has a longitudinal inclined groove axially formed therein, through which said bottom joined section of said pair of tongs can slide into said first tubular member.

* * * * *